US005470053A

United States Patent [19]

Kohlhage et al.

[11] Patent Number: 5,470,053

[45] Date of Patent: Nov. 28, 1995

[54] DEVICE FOR COLLECTING SHEET-LIKE NOTES AND FOR DISPENSING A BUNDLE OF NOTES

[75] Inventors: Hermann Kohlhage, Paderborn; Günter Baitz; Wolfgang Malke, both of Berlin, all of Germany

[73] Assignee: Siemens Nixdorf Informationssysteme Aktiengesellschaft, Paderborn, Germany

[21] Appl. No.: 74,830

[22] PCT Filed: Dec. 6, 1991

[86] PCT No.: PCT/EP91/02346

§ 371 Date: Jul. 30, 1993

§ 102(e) Date: Jul. 30, 1993

[87] PCT Pub. No.: WO92/10813

PCT Pub. Date: Jun. 25, 1992

[30] Foreign Application Priority Data

Dec. 7, 1990 [EP] European Pat. Off. ..... 90123599

[51] Int. Cl.[6] ..... B65H 31/04

[52] U.S. Cl. ..... 271/213; 271/220

[58] Field of Search ..... 271/207, 213, 271/220, 177; 221/194, 195, 191

[56] References Cited

U.S. PATENT DOCUMENTS 4,721,229 1/1988 Dempf et al. ..... 271/213 X

FOREIGN PATENT DOCUMENTS 3914178 10/1990 Germany .
1475178 6/1977 United Kingdom .
2171394 8/1986 United Kingdom .

OTHER PUBLICATIONS

"Easily Accessible Bill Dispense Box", IBM Technical Disclosure Bulletin, vol. 31, No. 3, Aug. 1988, pp. 432–433.
"Early Document Gap Error Detection", IBM Technical Disclosure Bulletin, vol. 30, No. 6, Nov. 1987, pp. 4–5.
"Document Issue Reject Box", IBM Technical Disclosure Bulletin, vol. 28, No. 2, Jul. 1985, pp. 565–566.

*Primary Examiner*—David H. Bollinger
*Attorney, Agent, or Firm*—Hill, Steadman & Simpson

[57] ABSTRACT

A device for collecting successively supplied sheet-like notes, for example printed documents, and for dispensing the collected bundle of notes at the dispensing station of a dispensing machine (2) comprises a collecting cartridge (20) which is arranged in the machine housing (4) such that it can be adjusted by means of an adjusting device between a collecting position (A), withdrawn in the machine housing (4), arranged at the end of a note conveyor (12), and a dispensing position (C), located in the dispensing station and accessible for access. At least the front part (36) of the bottom (22) close to the side wall (24) is designed as a door (48) which can be adjusted into an open position freeing a bottom opening, a cartridge compartment (42) being arranged underneath the collecting cartridge (20).

10 Claims, 1 Drawing Sheet

DEVICE FOR COLLECTING SHEET-LIKE NOTES AND FOR DISPENSING A BUNDLE OF NOTES

BACKGROUND OF THE INVENTION

1. Field of the Invention

The invention relates to a device for collecting successively supplied sheet-like notes, for example printed documents, and for dispensing the collected bundle of notes at the dispensing station of a dispensing machine.

2. Description of the Related Art

Such devices are used, for example, in the case of document printers in which printed documents of various formats are collected and fed to a dispensing station, from which the documents can be taken. Another field of application for such devices is the dispensing of money by automatic cash dispensers.

British published patent application 1,475,178 already discloses a device for collecting successively supplied sheet-like notes, for example printed documents, and for dispensing the collected bundle of notes at the dispensing station of a dispensing machine in which the notes are fed to the collecting cartridge via a side facing the interior of the machine, whereas the side of the collecting cartridge facing away from said interior is directed toward a removal opening and, in the removal position, is facing the remover. Since the notes come to bear against the side wall during collecting, they are flush there with respect to one another. In the case of notes of varying length, accordingly the side of the bundle of notes facing the remover is not flush. As a result, there is the risk that when the notes are removed not all the notes are grasped, so that individual notes remain in the collecting cartridge, which is not permissible for various reasons, in particular also on account of data protection.

SUMMARY OF THE INVENTION

It is the object of the present invention to provide a device for collecting successively supplied sheet-like notes, for example printed documents, and for dispensing the collected bundle of notes at the dispensing station of a dispensing machine, the device having a collecting cartridge which is arranged in the machine housing such that it can be swivelled between an inclined collecting position, arranged at the end of a note conveyor, and an at least approximately horizontal dispensing position, the collecting cartridge having a bottom and at least one side wall, bounding a bottom side, and this side wall forming in the collecting position a lower limitation of the inclined bottom in which the notes are offered to the remover always in the same position and, in the case of a bundle of notes of various length, always with flush edges.

This object is achieved according to the invention by the collecting cartridge being arranged in such a way that, in the dispensing position of the collecting cartridge, the end thereof assigned to the side wall faces the side from which the notes are removed.

The notes are collected flush at the end of the collecting cartridge which subsequently, in its dispensing position, is facing the remover, so that the notes are offered to the remover always identically and always with flush edges, irrespective of their length; in this way, the risk of individual notes not being grasped upon removal is eliminated to a great extent.

The notes are deposited by the note conveyor of the machine directly in the collecting cartridge; the collecting cartridge is then moved out of its collecting position into a dispensing position, in which access to the notes collected in the cartridge is possible.

The collecting cartridge may be of an extremely simple construction, since there are no particular requirements for the accuracy of its dimensions or of its mounting and guidance. It is regarded as a major advantage of the device according to the invention, in particular when collecting notes of various formats, that the bundle of notes remains in the collecting cartridge until removal and does not have to be removed and passed on by some handling means or other.

According to a further development of the invention, the collecting cartridge is preferably arranged above the note conveyor, conveying essentially vertically upward, so that the notes are introduced into the collecting cartridge via the side wall forming the lower termination of the bottom.

In a further development of the invention, a cover plate for the collecting cartridge is provided, which plate has in the collecting position of collecting cartridge a distance from the upper edge of the side wall which permits the passage of notes. This cover plate acts as a baffle plate, which deflects the notes supplied from below into the depositing space of the cartridge, as explained in more detail with reference to an exemplary embodiment.

In the dispensing position, the bottom of the collecting cartridge preferably has a position close to the horizontal, so that the notes to be removed are offered in an ergonomically favorable way, as if lying on a slightly inclined table. In the dispensing position of the collecting cartridge, the cover plate is set in a withdrawn position, permitting access to the notes.

In order that notes inadvertently not taken do not remain lying in the collecting cartridge and are possibly taken by the next user of the machine, it is provided according to the invention that at least the part of the bottom close to the side wall is designed as a door which can be adjusted into an open position, freeing a bottom opening, and that the lower part of the cartridge compartment, underneath the bottom, is designed as a collecting cartridge. This cartridge compartment serves as a so-called reject compartment. The opening of the door is initiated, for example, by a reject command once it has been established by corresponding sensors that the notes have not been taken; there is also the possibility of always opening the door whenever the collecting cartridge moves back out of the dispensing position into the collecting position.

In a preferred development of the invention it is provided that the adjustable door is designed as a position, against the force of restoring springs, by means of bands which can be wound onto a drivable roller arrangement, and then it is moved back into its closed position by the restoring springs. It has been shown that, with a slow opening movement of the sliding door, the documents perform an orderly sliding movement, so that they are laid on the bottom of the reject cartridge, beginning with the edge resting on the side wall, without losing their order.

The cartridge compartment arranged underneath the collecting cartridge may be arranged such that it can be removed or swivelled away from the collecting cartridge, so that the notes deposited there can be removed.

According to a further development of the invention, the cover plate is arranged in the machine housing such that it can be swivelled about a swivel axis arranged transversely with respect to the displacing movement of the collecting cartridge. It is swivelled by the collecting cartridge itself in such a way that, in the collecting position of the collecting cartridge, it performs its function as a baffle plate. Since the collecting cartridge performs a swivelling/displacing movement in the adjustment from the collecting position into the dispensing position, the cover plate, which can only perform a swivelling movement, remains behind, so that it frees the region of the collecting cartridge containing the notes, as explained more precisely hereinafter with reference to an exemplary embodiment.

In a further development of the invention it is provided that the collecting cartridge is coupled to a securing flap for the dispensing station of the machine, closing or freeing the dispensing station, in such a way that this securing flap is opened upon movement of the collecting cartridge into the dispensing position and is closed upon movement of the collecting cartridge into the collecting position.

BRIEF DESCRIPTION OF THE DRAWINGS

An exemplary embodiment of the invention is represented in the drawing and described in more detail below.

The FIGURE snows diagrammatically in a side view the upper part of a document printer, with a collecting cartridge in several operating positions.

DETAILED DESCRIPTION OF THE PREFERRED EMBODIMENTS

Figure 1:
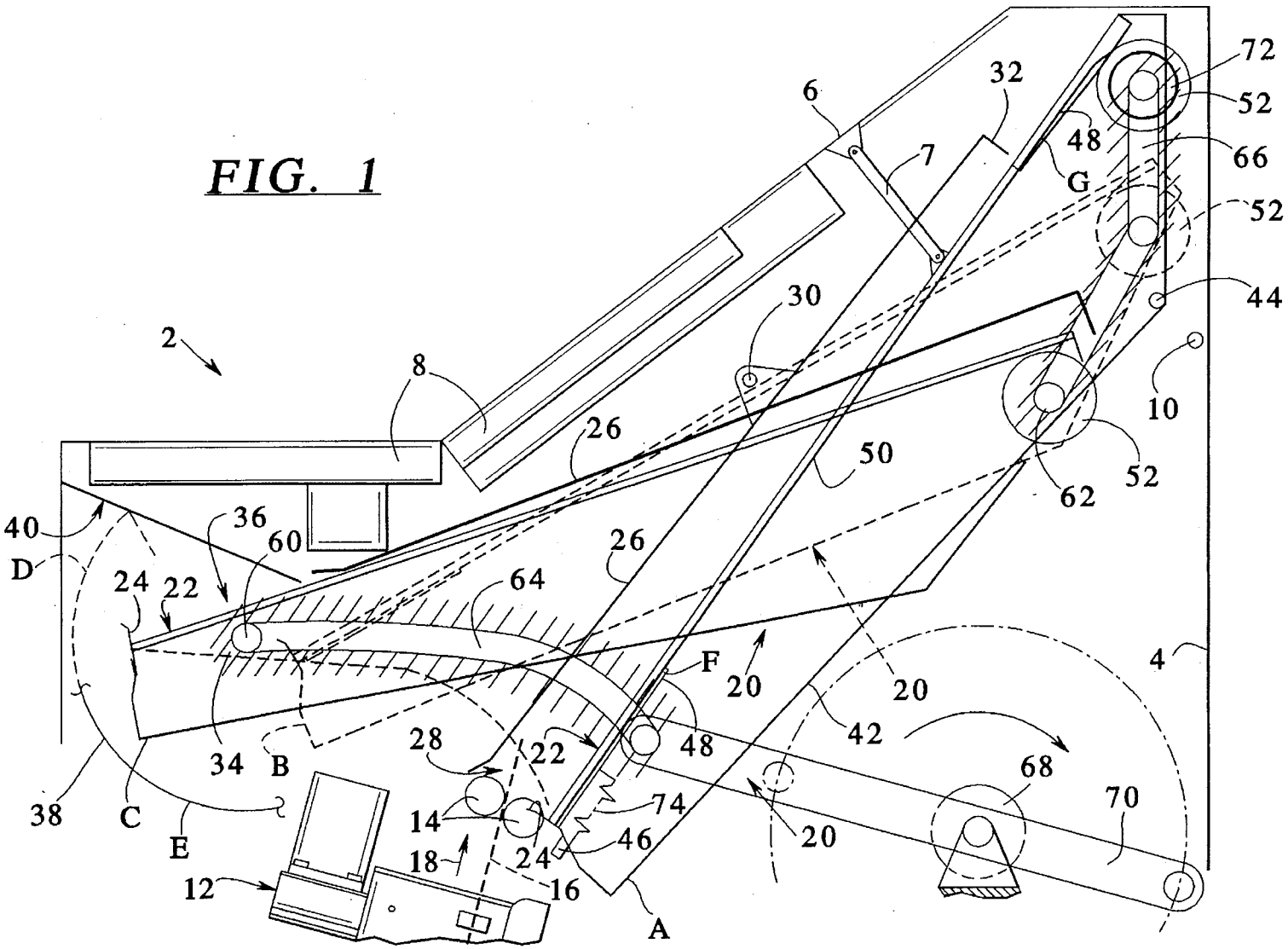

A dispensing machine 2 for printed documents comprises a machine housing 4 with a covering 6 mounted on its upper side, which covering is also provided with an operator control and display panel 8. The covering 6 can, for example for service purposes, be swivelled upward about a swivel axis 10 arranged on the rear side of the machine housing 4.

Arranged in the lower region (not shown) of the dispensing machine 2 are a printing device, paper supply stations etc. The printed documents are conveyed by a note conveyor 12, of which only the upper end can be seen in the FIGURE, into the upper region of the dispensing machine 2. The note conveyor 12 is of a conventional construction. It comprises a pair of conveying rollers 14, which are fixed to the machine and convey the respective printed document 16 in the direction of the arrow 18.

Arranged in the upper region of the machine housing 4 is a collecting cartridge, which is denoted as a whole by 20. This is adjustable, for example, by means of members 60 and 62 sliding in slotted guide links 64 and 66 between the collecting position A, represented by solid lines, via an intermediate position B, represented by dashed lines, into a dispensing position C, also represented by solid lines. For driving the collecting cartridge 20, a stepping motor 68 and a crank mechanism 70 are provided.

The collecting cartridge 20 has a bottom 22 and a side wall 24, bounding a bottom side. In the collecting position A represented, the bottom 22 assumes a steep position, close to the vertical, and the side wall 24 forms the lower termination of the bottom. A cover plate 26 is arranged essentially parallel to and at a distance from the bottom 22, so that a passage opening 28 for the documents 16 remains between the side wall 24 and the cover plate 26. The cover plate 26 serves as a baffle plate, which deflects oncoming documents 16 at high speed, so that they come to bear against the bottom 22.

The bottom 22 has an angle of about 55° with respect to the horizontal. It has been shown that an angle of 55° is very favorable, since in that case the documents still come to bear reliably against the bottom 22, but on the other hand are caused by their weight to slide downward, where they are supported by the side wall 24. Consequently, it is ensured that all the documents lie in the part of the collecting cartridge 20 which is subsequently accessible.

The cover plate 26 is mounted in the machine housing 4 such that it can swivel about a swivel axis 30. It is balanced in such a way that it has a tendency to swivel clockwise—with reference to the drawing. If the collecting cartridge 20 is adjusted into its collecting position A, it takes the rear end 32 of the covering 26 with it and adjusts it into the position represented, in which it can serve as a baffle plate for the supplied documents 16.

When a bundle of notes has collected in the collecting cartridge 20, the collecting cartridge 20 is adjusted out of its collecting position A into its dispensing position C. This adjusting movement is a swivelling/displacing movement, the front end of the collecting cartridge 20 approximately following the dashed line 34. As a result, the collecting cartridge 20 is on the one hand taken around machine components arranged in the dispensing machine 2, on the other hand it moves out of a collecting position A, withdrawn in the dispensing machine, into a dispensing position C, accessible for access.

In its adjustment out of the collecting position A into the dispensing position C, the collecting cartridge 20 takes the covering 26 with it. Since the covering 26 can only perform a swivelling movement, but not a displacement, it stays back in relation to the collecting cartridge 20, so that it frees the front region 36 of the collecting cartridge 20.

By means of a kinematic gear mechanism (not shown in any more detail, a securing flap 38 is also coupled to the collecting cartridge in such a way that, upon adjusting the collecting cartridge 20 into the dispensing position C, the securing flap 38 is swivelled out of the closed position D, represented by dashed lines, into the open position E, represented by solid lines, and vice versa. The documents lying in the front region 36 of the collecting cartridge 20 are now accessible through the access flare 40, formed in the upper covering 6, and can be removed.

A possibility is also provided of collecting in a separate reject compartment documents inadvertently not taken. For this purpose, a separate cartridge compartment 42, the so-called reject compartment, is 10 arranged underneath the bottom 22 of the collecting cartridge 20. This reject compartment 42 can be swivelled downward into an open position via a swivel axis 44 arranged in the rear region of the collecting cartridge 20, so that documents collected in the reject compartment can be removed. The reject compartment 42 can be locked in its closed position by means of a locking device 46.

In order to convey the documents collected in the front region 36 of the bottom 22 into the reject compartment 42, this front region 36 is designed as a sliding door 48, which can be adjusted by means of drawing bands 50 fastened to it out of the closed position denoted in the FIGURE by F into a rearwardly displaced open position denoted by G. The drawing bands 50 can be wound onto a drivable roller arrangement 52. The roller arrangement 52 is connected to a drive motor 72. The sliding door 48 can be adjusted back into its closed position, for example by restoring springs 74 which are tensioned upon opening.

It is envisaged to carry out the transfer of unremoved documents into the reject compartment in the intermediate position denoted in the FIGURE by B. It has been shown that, with the shown slight inclination of the collecting cartridge 20, upon opening the sliding door 48 the documents slide downward in an ordered movement into the reject compartment, i.e. do not lose their order. As a result, it is relatively simple when emptying the reject compartment in the event that a number of reject operations have taken place to separate from one another the documents to be assigned to the individual operations.

The reject operation can either be controlled by sensors, which establish that the documents have not been taken. Another possibility is that the sliding door 48 is always opened whenever the collecting cartridge 20 returns from the dispensing position C into the collecting position A, irrespective of whether there are unremoved documents in the collecting cartridge or not.

In another development it is provided that the swivel axis 30 of the cover plate is arranged on the covering 6 and that the upper part of the collecting cartridge 20 is connected to the covering 6 by means of drivers 7.

Upon opening of the covering 6, the cover plate 26 and the collecting cartridge 20 are taken upward with it, whereas the reject compartment retains its respective position. In this way, the reject compartment can be made accessible for removal of the documents in it by opening the covering 6.

Although other modifications and changes may be suggested by those skilled in the art, it is the intention of the inventors to embody within the patent warranted hereon all changes and modifications as reasonably and properly come within the scope of their contribution to the art.

We claim:

1. A device for collecting successively supplied sheet-like note and for dispensing a collected bundle of said sheet-like notes at a dispensing station of a dispensing machine, comprising:

a collecting cartridge pivotably mounted in a machine housing such that it can be swivelled between an inclined collecting position, at an end of a note conveyor, and an at least approximately horizontal dispensing position, said collecting cartridge having a bottom and at least one side wall, bounding a lower side of said collecting cartridge, and said side wall forming in a collecting position a lower limitation of said bottom against which said sheet-like notes accumulate when received from said note conveyor, said collecting cartridge being disposed in such a way that, when in said at least approximately horizontal dispensing position of said collecting cartridge, that said at least one side wall faces a side from which said sheet-like notes are removed, wherein in said inclined collecting position, said collecting cartridge is above said note conveyor, which conveys said sheet-like notes essentially vertically upward into said collecting cartridge at said lower side of said collecting cartridge.

2. A device for collecting successively supplied sheet-like note and for dispensing a collected bundle of said sheet-like notes at a dispensing station of a dispensing machine, comprising:

a collecting cartridge pivotably mounted in a machine housing such that it can be swivelled between an inclined collecting position, arranged at an end of a note conveyor, and an at least approximately horizontal dispensing position, said collecting cartridge having a bottom and at least one side wall, bounding a lower side of said collecting cartridge, and said side wall forming in a collecting position a lower limitation of said inclined bottom, said collecting cartridge being disposed in such a way that, when in said at least approximately horizontal dispensing position of said collecting cartridge, that said at least one side wall faces a side from which said sheet-like notes are removed; and a cover plate for said collecting cartridge, which in said inclined collecting position of said collecting cartridge is set in a position in which it is disposed a distance from an upper edge of said at least one side wall which permits passage of said sheet-like notes therebetween.

3. A device as claimed in claim 2, wherein, in said at least approximately horizontal dispensing position of said collecting cartridge, said cover plate is in a withdrawn position, permitting access to the sheet-like notes in said collecting cartridge by a user.

4. A device for collecting successively supplied sheet-like note and for dispensing a collected bundle of said sheet-like notes at a dispensing station of a dispensing machine, comprising:

a collecting cartridge pivotably mounted in a machine housing such that it can be swivelled between an inclined collecting position, at an end of a note conveyor, and an at least approximately horizontal dispensing position, said collecting cartridge having a bottom and at least one side wall, bounding a lower side of said collecting cartridge, and said side wall forming in a collecting position a lower limitation of said bottom against which said sheet-like notes accumulate when received from said note conveyor, said collecting cartridge being disposed in such a way that, when in said at least approximately horizontal dispensing position of said collecting cartridge, that said at least one side wall faces a side from which said sheet-like notes are removed wherein said collecting cartridge is mounted to perform a swivelling movement and a displacing movement between the collecting position and the dispensing position.

5. A device for collecting successively supplied sheet-like note and for dispensing a collected bundle of said sheet-like notes at a dispensing station of a dispensing machine, comprising:

a collecting cartridge pivotably mounted in a machine housing such that it can be swivelled between an inclined collecting position, arranged at an end of a note conveyor and an at least approximately horizontal dispensing position, said collecting cartridge having a bottom and at least one side wall, bounding a lower side of said collecting cartridge, and said side wall forming in a collecting position a lower limitation of said bottom, said collecting cartridge being disposed in such a way that, when in said at least approximately horizontal dispensing position of said collecting cartridge, said at least one side wall faces a side from which said sheet-like notes are removed, wherein at least a front part of said bottom close to said at least one side wall is a door which is movable into an open position, freeing a bottom opening, and a lower part of said collecting cartridge located underneath said bottom is a cartridge compartment for receiving notes through said door.

6. A device as claimed in claim 5, wherein said door is a sliding door.

7. A device as claimed in claim 6, wherein said sliding door is displaceable into an open position, against a force of restoring springs, by drawing bands which are wound onto a drivable roller arrangement.

8. A device as claimed in claim 5, wherein said cartridge compartment arranged underneath said collecting cartridge is selectively accessible by separation from said collecting cartridge.

9. A device as claimed in claim 5, wherein said cartridge compartment arranged underneath said collecting cartridge is swivellable away from said collecting cartridge.

10. A device as claimed in claim 5, wherein said cover plate and an upper part of said collecting cartridge coupled to a covering of said machine housing in such a way that they are lifted up from said cartridge compartment upon opening of said covering.

* * * * *